United States Patent [19]

Melai

[11] Patent Number: 4,538,093

[45] Date of Patent: Aug. 27, 1985

[54] VARIABLE FREQUENCY START CIRCUIT FOR DISCHARGE LAMP WITH PREHEATABLE ELECTRODES

[75] Inventor: Henri A. I. Melai, Eindhoven, Netherlands

[73] Assignee: U.S. Philips Corporation, New York, N.Y.

[21] Appl. No.: 376,808

[22] Filed: May 10, 1982

[30] Foreign Application Priority Data

May 14, 1981 [NL] Netherlands ..... 8102364

[51] Int. Cl.[3] ..... H05B 37/00; H05B 39/00; H05B 41/36

[52] U.S. Cl. ..... 315/219; 315/DIG. 5; 315/DIG. 7; 315/205; 315/283; 315/227 R; 331/113 A; 363/34; 363/40

[58] Field of Search ..... 315/DIG. 5, DIG. 7, 315/283, 227, 219, 209, 205, 207; 331/113 A; 363/34, 40

[56] References Cited

U.S. PATENT DOCUMENTS

| | | | |
|---|---|---|---|
| 3,084,283 | 4/1963 | Grunwaldt | 315/283 X |
| 3,146,406 | 8/1964 | Wilting | 331/113 A |
| 3,611,021 | 10/1971 | Wallace | 331/113 A |
| 3,896,336 | 7/1975 | Schreiner et al. | 315/DIG. 7 |
| 4,053,813 | 10/1977 | Kornrumpf et al. | 315/DIG. 7 |
| 4,099,099 | 7/1978 | Grudelbach | 315/DIG. 7 |
| 4,117,373 | 9/1978 | Alley | 315/DIG. 7 |
| 4,237,403 | 12/1980 | Davis | 315/DIG. 5 |
| 4,259,614 | 3/1981 | Kohler | 315/DIG. 7 |
| 4,277,728 | 7/1981 | Stevens | 315/DIG. 5 |
| 4,348,615 | 9/1982 | Garrison et al. | 315/DIG. 7 |
| 4,375,608 | 3/1983 | Kohler | 315/DIG. 7 |

FOREIGN PATENT DOCUMENTS

| | | | |
|---|---|---|---|
| 2071949 | 9/1981 | United Kingdom | 315/219 |

*Primary Examiner*—Saxfield Chatmon

*Attorney, Agent, or Firm*—Robert T. Mayer; Bernard Franzblau

[57] ABSTRACT

An arrangement for starting and supplying a discharge lamp (14) equipped with preheatable electrodes (15, 16). An electric coil (13) is arranged in series with the lamp and a capacitor (17) is arranged in parallel with the lamp. A voltage of a high frequency is first applied between the ends (A, B) of the series arrangement formed by the coil (13) and the lamp (14) whereafter approximately 1 second later said frequency is reduced until a series resonant condition is obtained and thereafter still further reduced to the operating frequency of the lamp. This starts the lamp (14) with the electrodes preheated to a sufficient extent.

17 Claims, 2 Drawing Figures

Figures 1, 2:
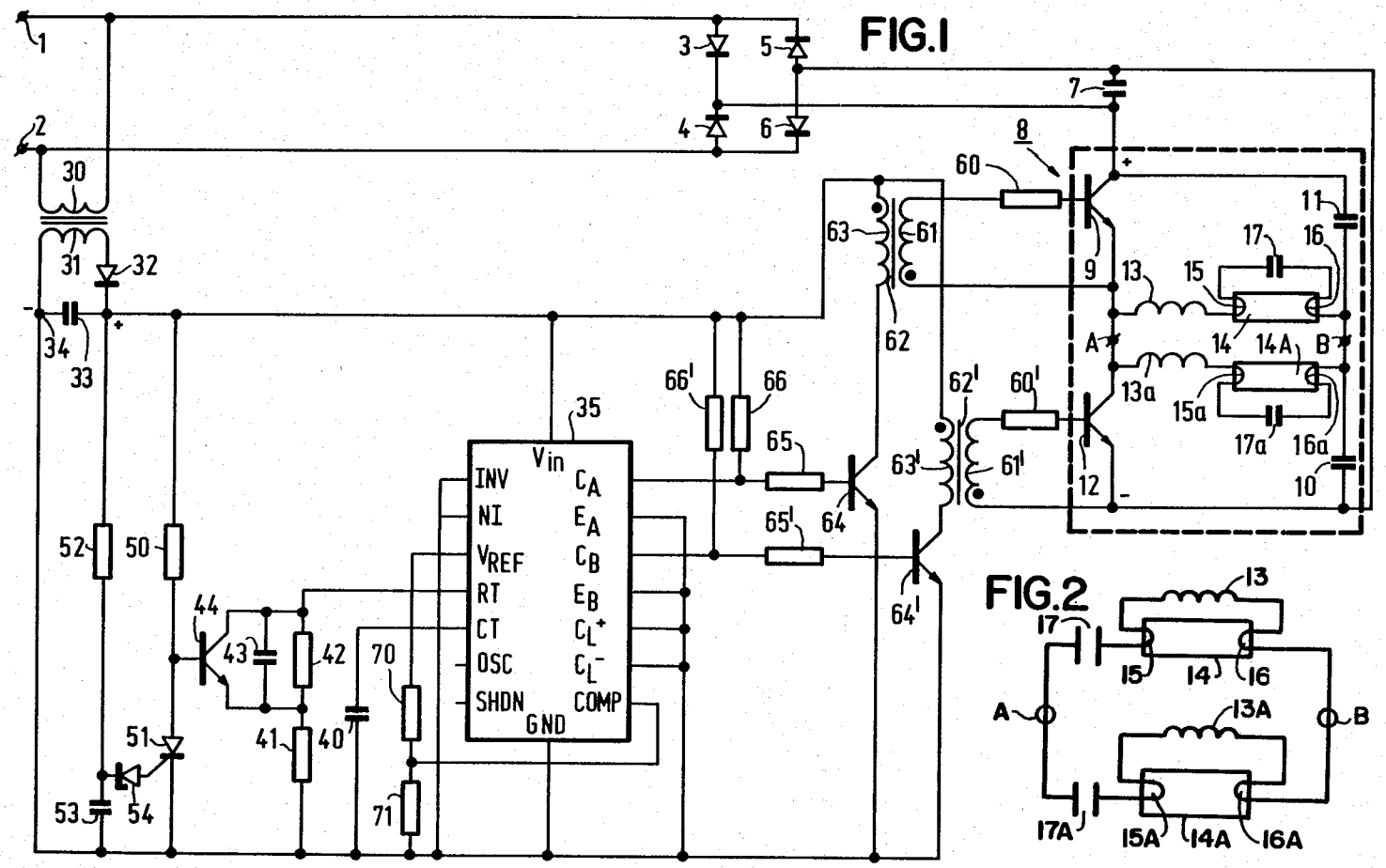

Vin
CA
EA
CB
EB
CL+
CL-
COMP
GND
INV
NI
VREF
RT
CT
OSC
SHDN

VARIABLE FREQUENCY START CIRCUIT FOR DISCHARGE LAMP WITH PREHEATABLE ELECTRODES

The invention relates to an electric arrangement for starting and supplying a gas and/or vapour discharge lamp comprising two preheatable electrodes. More particularly, the invention relates to a circuit for fluorescent lamps which includes, in the connected state of the lamp, a series arrangement of at least an electric coil, one of the lamp electrodes, a capacitor and the other lamp electrode, not necessarily in that order, with said series arrangement connected between two output terminals of an auxiliary device, and after switch-on of the electric arrangement the frequency of an electric voltage between the output terminals of the auxiliary device changes from an initial frequency to a lamp operating frequency, a realized frequency being the series resonant frequency of the electric coil and the capacitor.

A prior art electric arrangement of the type defined in the preamble is described in, for example, U.S. Pat. No. 3,710,177.

A disadvantage of the prior art electric arrangement is that the auxiliary device must be of such a construction that the r.m.s. voltage between the output terminals at the start of the lamp must be lower than during the operating condition of the lamp.

The invention has for an object to provide an electric arrangement of the type defined in the preamble wherein a proper start of the lamp, and the operating condition of the lamp occurring thereafter, can be realized substantially without a change in the r.m.s. voltage between the output terminals of the auxiliary device.

An electric arrangement according to the invention, for starting and supplying a gas and/or vapour discharge lamp having two preheatable electrodes, comprises in the connected condition of the lamp, a series arrangement including at least an electric coil, one of the lamp electrodes, a capacitor and the other lamp electrode, not necessarily in that order, with said series arrangement connected between two output terminals of an auxiliary device. After switch-on of the electric arrangement the frequency of an electric voltage between the output terminals of the auxiliary device changes from an initial frequency to a lamp operating frequency, a realized frequency being the series resonant frequency of the electric coil and the capacitor. This invention is characterized in that the series resonant frequency is located between the initial frequency and the lamp operating frequency with the initial frequency being higher than the series resonant frequency of the electric coil is in series with the lamp, whereas the initial frequency is lower than the series resonant frequency if the electric coil is in parallel with the lamp.

An advantage of this electric arrangement is that the auxiliary device may be of a simple construction as it need not be constricted such that at the start of the lamp there is a different r.m.s. voltage between its output terminals than during the operating condition of the lamp.

The invention is based on the idea to realize the different stages which must be passed through to have the lamp start properly and to have it thereafter pass to the operating condition predominantly by means of a frequency change. The said stages are:

(a) Preheating the lamp electrodes at a comparatively low voltage between the electrodes. This voltage must be low to prevent premature ignition of the lamp at a time when the electrodes are too cold as this usually reduces the operating life of the lamp.

(b) The application of a comparatively high voltage between the preheated electrodes to ignite the lamp.

(c) Transition to the operating condition of the lamp.

Consider first the situation in which the electric coil is connected in series with the lamp and the capacitor is in parallel with the lamp. Then the initial frequency (which is higher than the series resonant frequency) will produce a voltage across the electric coil that is comparatively high and the voltage between the lamp electrodes is rather low. At a same time the electrodes that are preheated in the circuit formed by the coil, first electrode, capacitor, second electrode.

The decrease in frequency realized thereafter results in the series resonance. The voltage across the capacitor is then high and consequently also the voltage across the lamp. The lamp ignites. Thereafter the frequency is decreased to the operating frequency.

By choosing—in accordance with the invention—the initial frequency to be higher than the series resonant frequency there is no rear—assuming that the r.m.s. value of the voltage between the output terminals of the auxiliary device remains constant—that the lamp will ignite while the electrodes are too cold. The above-mentioned prior art electric arrangement wherein the initial frequency is substantially equal to the series resonant frequency has the disadvantage mentioned in the foregoing that the r.m.s. value of the voltage between the output terminals of the auxiliary device during starting of the lamp must have a lower value than during the operating condition of the lamp.

In the situation in which the capacitor is in series with the lamp and the electric coil in parallel with the lamp, similar stages as described above occur. During the first stage there is however a comparatively low initial frequency. The frequency is thereafter increased to the series resonant frequency and thereafter further increased until the operating frequency of the lamp is reached.

In a preferred embodiment of an electric arrangement in accordance with the invention the auxiliary device comprises means for maintaining the initial frequency for 0.5 to 3 seconds.

An advantage of this preferred embodiment is that there is now ample time to preheat the electrodes. Ignition while the electrodes are too cold is then substantially wholly avoided.

In an improvement of the last-mentioned preferred embodiment the auxiliary device comprises means for providing a frequency swing from the initial frequency to the lamp operating frequency within not more than 2 milliseconds.

An advantage of this improvement is that the series resonant condition is of an extremely short duration. This series resonant condition is indeed advantageous in order to have the lamp ignite on the high voltage between the electrodes, but maintaining this situation for a prolonged period of time might result in damage, inter alia owing to insulation breakdown.

In a still further improved version of said preferred embodiment of an electric arrangement in accordance with the invention the auxiliary device comprises a control oscillator of which at least a capacitive circuit element is shunted by a controlled semiconductor element, and that said semiconductor switching element comprises a control circuit having an input circuit arranged in parallel with a supply circuit of the oscillator. The control circuit has such a small time constant that after 0.5 to 3 seconds after switch-on of the electric arrangement it adjusts the semiconductor switching element from the conductive to the non-conductive state.

An advantage of this further improvement is that the initial frequency can be maintained in a simple way during the period of 0.5 to 3 seconds so that preheating of the electrodes is ensured to a sufficient extent.

In another improvement of a preferred embodiment of an electric arrangement in accordance with the invention the capacitive circuit element is bypassed via a first resistor. The parallel arrangement of the capacitive circuit element, the first resistor and the semiconductor switching element is connected in series with a second resistor. The capacitance of the capacitive circuit element is so small that it is charged to a final value within not more than 2 seconds after the semiconductor switching element has become non-conductive.

An advantage of this last improvement is that the frequency swing, from the initial frequency to the operating frequency of the lamp, is now realized within 2 mseconds.

The invention will now be further described by way of example with reference to the accompanying drawing in which FIG. 1 shows an electric circuit of an electric arrangement in accordance with the invention; and FIG. 2 shows a modified form of the auxiliary device of FIG. 1.

In this circuit reference numerals 1 and 2 denote input terminals which are intended to be connected to an a.c. voltage of approximately 220 V, 50 Hz. A full-wave rectifier bridge is connected to the terminals 1 and 2. This bridge includes four diodes 3 to 6, inclusive. Two output terminals of said diode bridge are interconnected by a capacitor 7. A bridge circuit 8 which forms part of an auxiliary device is fed via the capacitor 7. A first branch of the bridge 8 comprises a transistor 9. A second branch of the bridge comprises a capacitor 10. A third branch of the bridge comprises a capacitor 11 and a fourth branch of the bridge 8 comprises a transistor 12. A and B are the output terminals of the auxiliary device. Two substantially identical series arrangements are located between terminals A and B. These series arrangements comprise auxiliary coils 13 and 13*a*, respectively, in series with low-pressure mercury vapour discharge lamps 14 and 14*a*, respectively. The lamp 14 has two preheatable electrodes 15 and 16, respectively. The lamp 14*a* has two preheatable electrodes 15*a* and 16*a*, respectively. Those ends of the electrodes 15 and 16 which face away from the supply source are interconnected by a capacitor 17. Those ends of the electrodes 15*a* and 16*a* which face away from the supply source are interconnected by a capacitor 17*a*. The portion of the circuit described so far is the main current portion.

The remaining portion of the circuit relates to the control circuit of the transistors 9 and 12. This remaining portion forms part of the auxiliary device.

The following holds for this control circuit. A primary winding 30 of an auxiliary transformer, the secondary winding of which is denoted by 31, is connected to the terminals 1 and 2. One end of the secondary winding 31 is connected to a diode 32. The other end of this diode and the other end of the secondary winding 31 are interconnected via a capacitor 33. A junction point between the diode 32 and the capacitor 33 is connected to an integrated circuit voltage regulator 35, e.g. a Signetics type SG-1524. The connection of the junction point between the diode 32 and the capacitor 33 is connected to the terminal VIN of the circuit element 35. A junction point 34 of the secondary transformer winding 31 and the capacitor 33 is connected to the terminals INV, NI, GND, $E_A$, $E_B$, $C_L^+$ and $C_L^-$ of the circuit element 35.

The junction point 34 is further connected to a capacitor 40. The other side of this capacitor 40 is connected to the terminal $C_T$ of circuit element 35. The junction point 34 is also connected to a resistor 41. The other side of this resistor 41 is connected to a parallel arrangement of a resistor 42, a capacitor 43 and the main electrodes of a transistor 44. The other side of this parallel arrangement is connected to the terminal $R_T$ of the circuit element 35. The junction point between the diode 32 and the capacitor 33 is also connected to a resistor 50. The other side of this resistor 50 is connected to a thyristor 51. The other side of this thyristor is connected to the junction point 34. A junction point between resistor 50 and the thyristor 51 is connected to the base of the transistor 44. The junction point between the diode 32 and the capacitor 33 is furthermore connected to a resistor 52. The other side of this resistor 52 is connected to a capacitor 53. The other side of this capacitor is connected to the junction point 34. A control electrode of the thyristor 51 is connected to a junction point between the resistor 52 and the capacitor 53 via a Zener diode 54.

The base of the transistor 9 is connected to a resistor 60. The other side of this resistor 60 is connected to one end of a secondary winding 61 of an isolation transformer 62. The other end of the winding 61 is connected to the emitter of the transistor 9. One end of a primary winding 63 of the transformer 62 is connected to the collector of an auxiliary transistor 64, and the other end to the junction point between the diode 32 and the capacitor 33. The emitter of the auxiliary transistor 64 is connected to the junction point 34. The base of the auxiliary transistor 64 is connected to a resistor 65. The other side of the resistor 65 is connected to the terminal $C_A$ of the circuit element 35 and also to a resistor 66. The other side of the resistor 66 is connected to the capacitor 33.

The control circuit of the transistor 12 is substantially identical to the control circuit of the transistor 9. The corresponding circuit elements in the control circuit of the transistor 12 have been provided with an accent notation. The connection of the control circuit of transistor 12 to the circuit element 35 is effected at terminal $C_B$.

Finally, the terminal $V_{REF}$ of the circuit element 35 is connected to the terminal 34 via a resistive divider 70, 71. A tapping point between the resistors 70 and 71 is connected to the terminal COMP of the circuit element 35.

The combination of the circuit elements 35, 40, 41, 42, 43 is referred to as the control oscillator.

The control of the bridge circuit 8 is such that the transistors 9 and 12 are alternately in the conducting state in response to substantially square-wave control voltages. As a result thereof an alternating current flows through the lamps (14, 14*a*) in the operating condition.

In a practical embodiment the capacitance of the capacitor 7 is approximately 50 μFarad. The capacitance of the capacitor 10 is approximately 0.5 μFarad.

The capacitance of the capacitor 11 is approximately 0.5 μFarad. The capacitance of each of the capacitors 17 and 17*a* is approximately 12 nanoFarad. The capacitance of the capacitor 33 is approximately 100 μFarad. The capacitance of the capacitor 43 is approximately 100 nanoFarad. The capacitance of the capacitor 53 is approximately 4.7 μFarad. The inductance of the coil 13 and also of the coil 13*a* is approximately 1.6 milli-Henry. The transformation ratio of the transformer 30, 31 is approximately 20:1. The resistor 41 has a value of approximately 8.2 kOhm. The resistor 42 has a value of approximately 10 kOhm. The resistor 50 has a value of approximately 100 kOhm. The resistor 52 has a value of approximately 220 kOhm. The resistors 60 and 60' each have a resistance value of approximately 12 Ohm. Each of the two resistors 60 and 60' is bypassed by a capacitor, not shown, having a capacitance of approximately 2.2 μFard. The resistor 65 and the resistor 65' each has a value of approximately 560 Ohm. The resistor 66 and also the resistor 66' have a value of approximately 560 Ohm. The resistor 70 has a value of approximately 6.8 kOhm and the resistor 71 has a value of approximately 10 kOhmn. The Zener voltage of the Zener diode is approximately 7.5 Volts.

In this embodiment the voltage supply for the bridge 8 is approximately 280 Volts. The auxiliary voltage across the capacitor 33 is approximately 12 Volts. Each of the two lamps 14 and 14*a*, respectively is a lamp of approximately 50 Watts.

In this embodiment the initial frequency for the supply of the lamps 14 and 14*a* is approximately 45 kHz. The series resonant frequency of the coil 13 with the capacitor 17 is approximately 36 kHz. This same series resonant frequency is present for the case of the coil 13*a* and the capacitor 17*a*. The lamp operating frequency is approximately 25 kHz for each of the two lamps. The effective value of the voltage between the output terminals A and B is not lower at the initial frequency then afterwards.

The operating principle of the circuit described is as follows. When the terminals 1 and 2 are connected to the voltage of approximately 220 V, 50 Hz, the capacitor 7 is charged via the diode bridge 3 to 6, inclusive. The transistor 44 is then immediately conducting. Then the initial frequency is present between terminals A and B. The capacitor 53 is charged via the resistor 52 until the Zener voltage of the Zener diode 54 is reached. Then thyristor 51 becomes conductive with the result that the transistor 44 is rendered non-conductive after approximately one second. In turn the short-circuit across the capacitor 43 is removed. In the still-conducting state of the transistor 44 the circuit elements 40 and 41 together determined the frequency at which the transistors 9 and 12 were rendered conductive. Owing to the fact that the transistor 44 is rendered non-conductive the resistor 42 and the capacitor 43 also take part in the determination of the frequency at which the transistors 9 and 12 are rendered conductive. A transitional situation is created by the charging of the capacitor 43. The transistor 44 then conducts for approximately 1 second. The capacitor 43 which has a capacitance value of approximately 100 nanoFarad, as mentioned in the foregoing, results in a frequency swing from the initial frequency to the operating frequency of the lamp, which swing has a duration of approximately ½ msec.

An advantage of the described circuit is that in this high-frequency mode of operating the lamp, starting of the lamp by variation of the frequency is accomplished in a reliable manner.

In the operating condition each of the two lamps has a luminous flux of approximately 5000 lumen.

FIG. 2 illustrates a second version of the invention in which the capacitors 17 and 17*a* are now in series with the lamps 14 and 14*a* and the inductors 13 and 13*a* are in shunt with the lamps 14 and 14*a*, respectively. The operation of this version is similar to that of FIG. 1, except that now the initial frequency is lower than the series resonant frequency of each series LC circuit, i.e. of 17, 13 or 17*a*, 13*a*.

What is claimed is:

1. An electric arrangement for starting and supplying an electric discharge lamp having two preheatable electrodes comprising, in the connected condition of the lamp, means connecting an inductive element, one of the lamp electrodes, a capacitive element and the other lamp electrode in a series arrangement such that one of said elements is in series with the lamp and the other one of said elements is in parallel with the lamp, means connecting said series arrangement between two output terminals of an auxiliary device, said auxiliary device including means for generating an alternating voltage and means for varying the frequency thereof after switch-on of the electric arrangement from an initial frequency to a lamp operating frequency independent of lamp current, the inductive element and the capacitive element having a series resonant frequency falling between the initial frequency and the lamp operating frequency, and means coupling the alternating voltage to the two output terminals of the auxiliary device.

2. An electric arrangement as claimed in claim 1 wherein said alternating voltage generating means maintains the initial frequency for 0.5 to 3 seconds after switch-on of the electric arrangement thereby to preheat the lamp electrodes.

3. An electric arrangement as claimed in claim 2 wherein said frequency varying means produces a frequency swing from the initial frequency to the lamp operating frequency within a period of not more than 2 milliseconds.

4. An electric arrangement as claimed in claim 1 characterized in that the voltage generating means comprises a control oscillator having a second capacitive element shunted by a controlled semiconductor switching element, and wherein said semiconductor switching element includes a control circuit having an input circuit coupled in parallel with a supply circuit of the oscillator, the control circuit having a time constant such that after 0.5 to 3 seconds after switch-on of the electric arrangement it adjusts the semiconductor switching element from a conductive to a non-conductive state.

5. An electric arrangement as claimed in claim 4 wherein the second capacitive element is connected in shunt with a first resistor, and means connecting the parallel circuit of the second capacitive element, the first resistor and the semiconductor switching element in series with a second resistor, the capacitance of the second capacitive element being chosen so that it is charged to a final value within not more than 2 milliseconds after the semiconductor switching element was made non-conductive.

6. An electric arrangement as claimed in claim 1 wherein the inductive element is in series with the lamp and the capacitive element is in parallel with the lamp, and wherein the initial frequency is higher than the series resonant frequency of the inductive element and the capacitive element.

7. An electric arrangement as claimed in claim 1 wherein the capacitive element is in series with the lamp and the inductive element is in parallel with the lamp, and wherein the initial frequency is lower than the series resonant frequency of the inductive element and the capacitive element.

8. An auxiliary device for starting and operating an electric discharge lamp having preheatable electrodes, said lamp being connected in a series arrangement including an inductive element, a first lamp electrode, a capacitive element and a second lamp electrode with one of said elements in series with the lamp and the other one of said elements in parallel with the lamp, said auxiliary device comprising: two output terminals for connection to said series arrangement, a control oscillator for generating an alternating voltage having an initial frequency before ignition of a discharge lamp when connected to said output terminals, means for varying the frequency of the control oscillator from said initial frequency to a lamp operating frequency, means for delaying the operation of said frequency varying means after energization of the auxiliary device for a time period sufficient to preheat the lamp electrodes, said inductive element and capacitive element having a series resonant frequency intermediate the initial frequency and the lamp operating frequency so that a relatively high lamp ignition voltage is produced as the frequency of the control oscillator passes through said series resonant frequency during a frequency variation of the control oscillator from the initial frequency to the lamp operating frequency, and means for coupling the alternating voltage of the control oscillator to said output terminals.

9. An auxiliary device as claimed in claim 8 wherein said frequency varying means comprises an electric reactance element coupled to a frequency determining network of the control oscillator via a semiconductor switching element controlled by said delaying means.

10. An auxiliary device as claimed in claim 8 wherein said control oscillator includes a frequency determining network having a first capacitor that determines the initial frequency and a second capacitor that at least partly determines the operating frequency, and wherein said delaying means comprises a controlled semiconductor switching element for coupling the second capacitor into the frequency determining network upon completion of the preheat period, and a control circuit coupled to a control electrode of the switching element and to a source of DC supply voltage for the control oscillator and including an RC circuit with a time constant that determines said preheat time period.

11. An auxiliary device as claimed in claim 8 wherein said control oscillator includes a frequency determining network including frequency determining capacitance means, and a semiconductor switching element coupled to said capacitance means for adjusting the value of the capacitance thereof between first and second values that determine the initial and operating frequencies, respectively, of the control oscillator.

12. An auxiliary device as claimed in claim 8 wherein said control oscillator includes a frequency determining network including a capacitor connected in parallel with a controlled semiconductor switching element, and wherein said delaying means includes a control circuit coupled to a control electrode of the switching element and having a time constant that allows the switching element to switch state at the end of the preheat time period.

13. An auxiliary device as claimed in claim 12 wherein the frequency determining network includes a second capacitor permanently connected therein.

14. An auxiliary device as claimed in claim 8 wherein said two output terminals comprise the output terminals of a bridge circuit having two input terminals coupled to a source of DC voltage and first and second branch circuits coupled between said two input terminals, the first branch including first and second transistors connected in series circuit and the second branch comprising first and second capacitors connected in a second series circuit.

15. An auxiliary device as claimed in claim 14 wherein said coupling means includes a transformer having an input winding coupled to the output of the control oscillator and output winding means coupled to control electrodes of the first and second transistors to alternately drive the transistors into conduction during mutually exclusive time intervals.

16. An auxiliary device as claimed in claim 8 wherein the initial frequency of the alternating voltage generated by the control oscillator produces a greater voltage across said one element than across the other one of said elements during said preheat time period.

17. An auxiliary device as claimed in claim 8 wherein said control oscillator includes a frequency determining network including a capacitor that determines the operating frequency of the control oscillator independent of the lamp current.

* * * * *